US009321088B2

(12) United States Patent
Doty

(10) Patent No.: US 9,321,088 B2
(45) **Date of Patent: *Apr. 26, 2016**

(54) APPARATUS FOR CLEANING BLEEDER VALVES

(71) Applicant: Arthur Doty, Round Rock, TX (US)

(72) Inventor: Arthur Doty, Round Rock, TX (US)

(73) Assignee: Arthur W. Doty, Round Rock, TX (US)

( * ) Notice: Subject to any disclaimer, the term of this patent is extended or adjusted under 35 U.S.C. 154(b) by 63 days.

This patent is subject to a terminal disclaimer.

(21) Appl. No.: 14/048,185

(22) Filed: Oct. 8, 2013

(65) Prior Publication Data

US 2014/0033456 A1 Feb. 6, 2014

Related U.S. Application Data

(63) Continuation of application No. 12/024,207, filed on Feb. 1, 2008, now Pat. No. 8,584,296.

(51) Int. Cl.

| | |
|---|---|
| ***B08B 9/02*** | (2006.01) |
| ***B08B 9/00*** | (2006.01) |
| ***B08B 9/045*** | (2006.01) |

(52) U.S. Cl.

CPC .. *B08B 9/045* (2013.01); *B08B 9/00* (2013.01)

(58) Field of Classification Search

CPC ..... B08B 9/00; B08B 9/02; B08B 9/045

USPC ..... 15/104.095, 104.16

See application file for complete search history.

(56) References Cited

U.S. PATENT DOCUMENTS 1,559,709 A * 11/1925 Knapp ..... E21B 7/24 173/131

8,584,296 B2 * 11/2013 Doty ..... B08B 9/00 15/104.03

* cited by examiner

*Primary Examiner* — Monica Carter

*Assistant Examiner* — Stephanie Berry

(74) *Attorney, Agent, or Firm* — Anthony P. Ng; Russell Ng PLLC

(57) ABSTRACT

An apparatus for cleaning bleeder valves is disclosed. The apparatus includes a rigid casing and a flexible casing rotatably connected to the rigid casing. The flexible casing is adapted to provide fluid-tight coupling of the flexible casing to a bleeder valve. Within the flexible casing, a flexible shaft is rotatably mounted and extended from one end of the flexible casing to a position outwardly of an opposite end of the flexible casing. Connected to the flexible shaft is a drill bit adapted for engagement to breakdown sediments. The drill bit includes a tip, a first and second flutes. The first and second flutes are extended longitudinally along the length of the drill bit, and are relatively straight. The first flute includes a first cutting edge, and the second flute includes a second cutting edge. Also connected to the rigid casing is a valve adapted for selective venting of an interior of the rigid casing.

10 Claims, 3 Drawing Sheets

APPARATUS FOR CLEANING BLEEDER VALVES

RELATED APPLICATION

The present application is a continuation of U.S. non-provisional application No. 12/024,207, filed on Feb. 1, 2008, the contents of which are incorporated herein by reference.

BACKGROUND OF THE INVENTION

1. Technical Field

The present invention relates to bleeder valves in general, and in particular to an apparatus for cleaning bleeder valves.

2. Description of Related Art

Bleeder valves are widely employed for extracting small samples from a large body of fluids located in a pipe or within a storage tank. For example, a bleeder valve can be utilized to extract samples of fluid passing through a huge pipeline or to remove water from the bottom of a gasoline storage tank. Since the diameters of bleeder valves are usually much smaller than the diameters of pipes with which they are associated, thus they get clogged frequently. For example, bleeder valves designed for removing material from the bottom of a storage tank will get clogged with sediments, and bleeder valves in process lines may get clogged with coke, scale or solid reaction products.

Conventional bleeder valve cleaners allow bleeder valves to be cleaned without any fluid leakage from the bleeder valves. However, bleeder valves are typically placed in locations that are difficult to access, and conventional bleeder valve cleaners are generally not designed to operate in confined spaces. Consequently, it would be desirable to provide an improved apparatus for cleaning bleeder valves.

SUMMARY OF THE INVENTION

In accordance with a preferred embodiment of the present invention, an apparatus for cleaning bleeder valves includes a rigid casing and a flexible casing rotatably connected to the rigid casing. The flexible casing is adapted to provide fluid-tight coupling of the flexible casing to a bleeder valve. Within the flexible casing, a flexible shaft is rotatably mounted and extended from one end of the flexible casing to a position outwardly of an opposite end of the flexible casing. Connected to the flexible shaft is a drill bit adapted for engagement to breakdown sediments. The drill bit includes a tip, a first and second flutes. The first and second flutes are extended longitudinally along the length of the drill bit, and are relatively straight. The first flute includes a first cutting edge, and the second flute includes a second cutting edge. Also connected to the rigid casing is a valve adapted for selective venting of an interior of the rigid casing.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
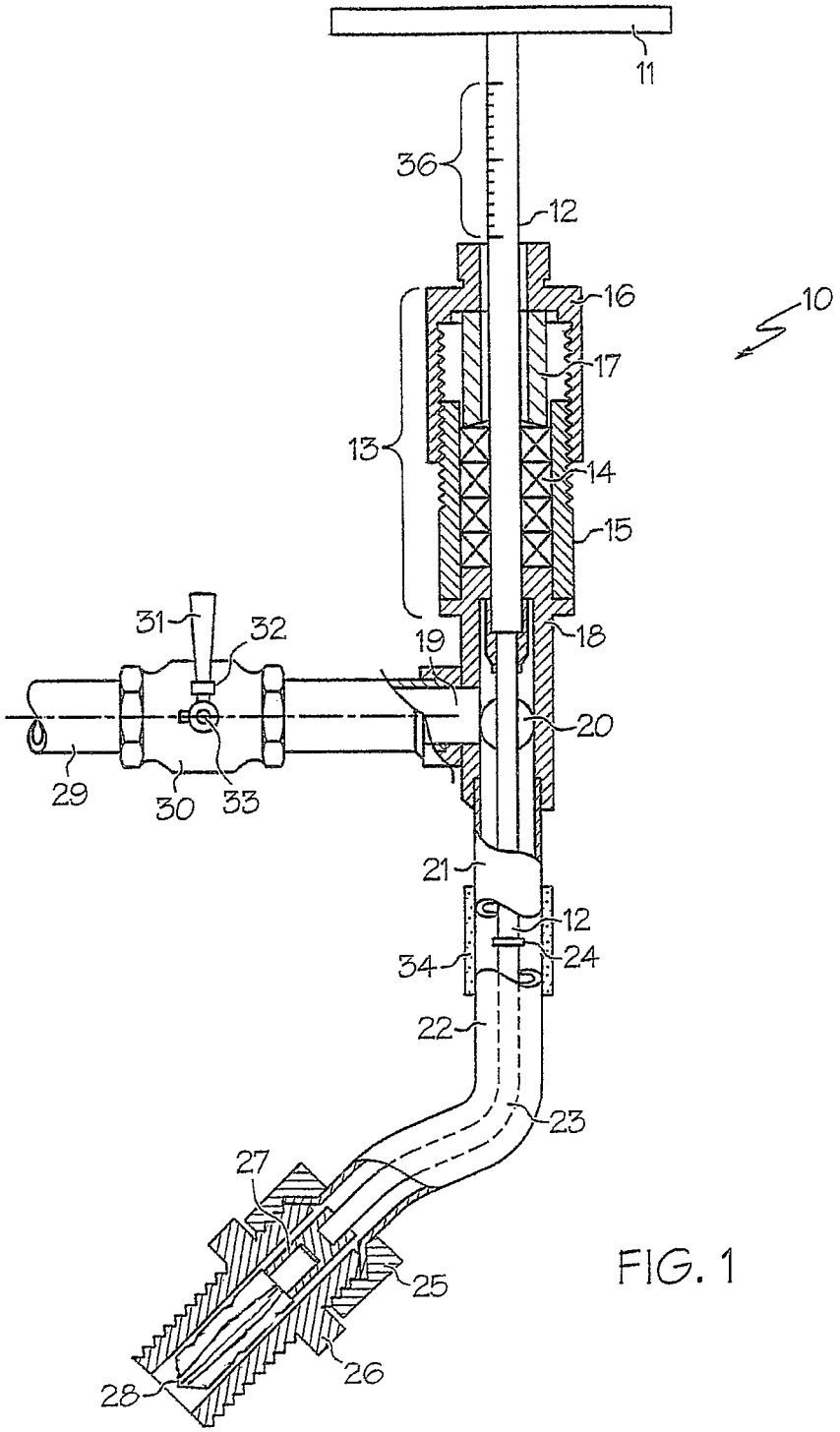
FIG. 1 is a cross-sectional diagram of an apparatus for cleaning bleeder valves, in accordance with a preferred embodiment of the present invention.

Referring now to the drawings and in particular to FIG. 1, there is depicted a cross-sectional diagram of an apparatus for cleaning bleeder valves, in accordance with a preferred embodiment of the present invention. As shown, a bleeder valve cleaner 10 includes a handle 11 connected to a rigid shaft 12 that passes through a packing gland 13. Packing gland 13 includes a packing 14, a housing 15 for containing packing 14 snugly, a packing nut 16 adapted to engage a threaded connection on housing 15 as well as to fit snugly around rigid shaft 12, and a packing compression element 17 that fits into housing 15 for compressing packing 14 when packing nut 16 is being tightened. Housing 15 is connected to a closure element 18 for restraining packing 14 when being compressed by packing compression element 17. Closure element 18 is also adapted with a threaded hole 19 to receive a suitable valve assembly. Closure element 18 may also include an opening 20 adaptable to receive condition sensing instruments such as pressure gauges, thermometers, etc.

A rigid casing 21 is attached to closure element 18 in a fluid-tight relationship. Rigid casing 21 is also connected to a flexible casing 22 in a fluid-tight relationship via a connector 34. Flexible casing 22 is preferably made of a material that allows flexible casing 22 to be bent in any position, and such material is adapted to withstand temperature, pressure and chemical compositions of any substances that will enter flexible casing 22 during a bleeder valve cleaning operation. Although flexible casing 22 is not necessary to be made of material that will withstand corrosion for a prolonged period of time, the material must be able to withstand corrosion and/or any other chemical reaction throughout the duration of a bleeder valve cleaning operation.

The end of rigid shaft 12, which may extend into flexible casing 22, is connected to a flexible shaft 23 within flexible casing 22. Flexible shaft 23, such as a steel cable, is capable of bending along with flexible casing 22 but still has sufficient stiffness so that rotating one end of flexible shaft 23 will cause the other end to rotate. A coupling 24 is utilized to connect rigid shaft 12 with flexible shaft 23 by welding coupling 24 to rigid shaft 12 and flexible shaft 23. A flared joint 25 is utilized to engage the threads of a valve with an adaptor to make a fluid-tight seal with a bleeder valve (not shown) to be cleaned. Flexible shaft 22 is connected to a drill bit 28.

Figure 2A:
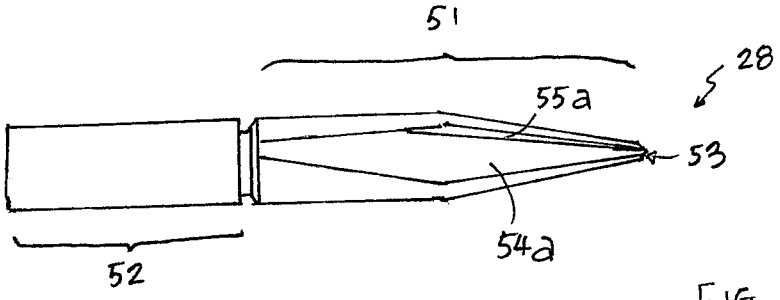
FIGS. 2*a*-2*c* are front and side views of a drill bit for the apparatus from FIG. 1, in accordance with a preferred embodiment of the present invention.
Figure 2B:
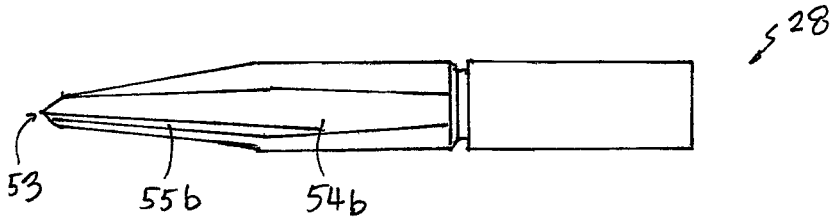
Figure 2C:
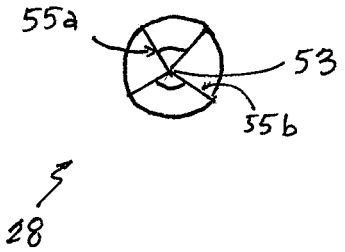

With reference now to FIGS. 2*a*-2*c*, there are depicted various views of drill bit 28, in accordance with a preferred embodiment of the present invention. As shown, drill bit 28 includes a head 51 and a connector 52. Drill bit 28 can be attached to flexible shaft 22 via a coupling 27 (from FIG. 1). Head 51 includes a tip 53, a first flute 54*a* and a second flute 54*b*. First and second flutes 54*a*, 54*b* are extended longitudinally along head 51, and are relatively straight. First flute 54*a* includes a cutting edge 55*a*, and similarly, second flute 54*b* includes a cutting edge 55*b*. Cutting edges 55*a*, 55*b* are adapted to drill and advance through accumulated solids within a bleeder valve.

Drill bit 28 is manufactured so that a rotation of handle 11 in one direction will cause drill bit 28 to drill and advance through accumulated solids within a bleeder valve. Both flexible shaft 23 and drill bit 28 should be advanced to the bleeder valve when handle 11 is being rotated to insert or retract. Preferably, the diameter of drill bit 28 is approximately ¼ inch. The lengths of first and second flutes 54*a*, 54*b* range from 1.5 inches to 2.5 inches.

The length of flexible shaft 22 should be such that drill bit 28 is partially resided within flexible casing 22 when rigid shaft 12 is fully retracted. The length of rigid shaft 12 should be such that when it is advanced into rigid casing 21, it will be long enough to force drill bit 28 far enough into a bleeder valve to dislodge any solids, crusts or sediments that are interfering with the free-flowing of fluid through the bleeder valve. A set of scales (or markings) 36 can be placed near handle 11 of rigid shaft 12. The purpose of scales 36 is to allow a user to conveniently identify when drill bit 28 is fully retracted from a bleeder value, fully extended within a bleeder value, or somewhere in between by looking at scales 36.

Bleeder valve cleaner 10 also includes a valve 30 capable of being connected to a suitable piping 29 to discharge any fluid or solid within rigid casing 21 to an area where such discharge is safe. If it is not desirable to carry away any fluid or solid within rigid casing 21 during the bleeder valve cleaning process, valve 30 may be maintained closed via a safety handle 31. Along with flexible casing 22, connector 34 allows safety handle 31 and packing gland 13 to be rotated to a relatively horizontal position irrespective of the position of drill bit 28. The relatively horizontal position allows an operator of bleeder valve cleaner 10 to access handle 11 with ease despite the direction at which drill bit 28 needs to be pointed because of the location of the bleeder valve. In contrast, since the entire casing of the prior art bleeder valve cleaners are rigid, an operator may need to be performing the cleaning operation in an awkward position depending of the location of bleeder valves. In addition, the relatively horizontal position allows a safety latch (not shown) located on safety handle 31 to work properly because the safety latch can stay in place due to gravity only when safety handle 31 is positioned in a relatively horizontal position.

Figure 3A:
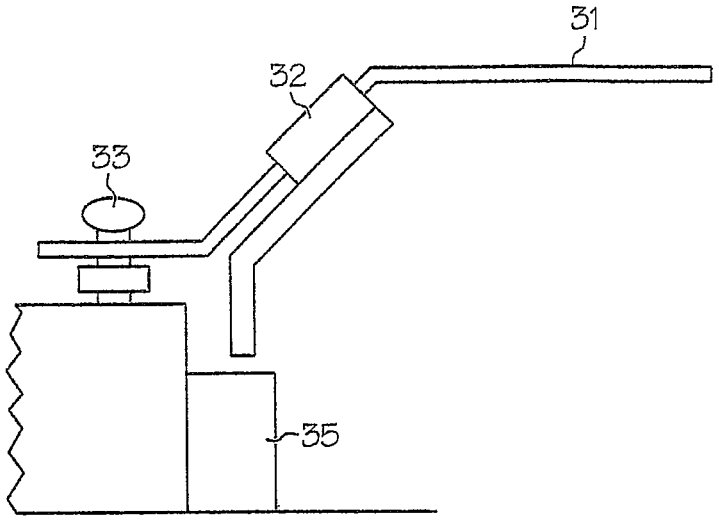
FIGS. 3*a*-3*b* are horizontal views of a safety handle for the apparatus from FIG. 1, in accordance with a preferred embodiment of the present invention.
Figure 3B:
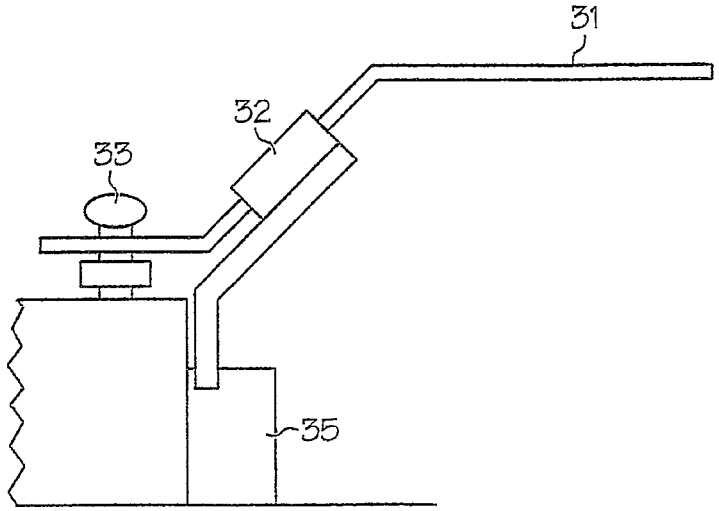

Referring now to FIGS. 3*a*-3*b*, there are illustrated two horizontal views of safety handle 31, in accordance with a preferred embodiment of the present invention. As shown, a safety latch 32 is associated with safety handle 31. When safety latch 32 is placed in a position shown in FIG. 3*a*, safety handle 31 can be freely rotate about a knob 33 on valve 30. However, when safety latch 32 is placed in a position shown in FIG. 3*b*, safety latch 32 is engaged with a stop 35 such that safety handle 31 is prevented from any rotation about knob 33 on valve 30. When safety handle 31 is placed a relatively horizontal position, such as the position shown in FIG. 2*b*, safety latch 32 will remain engaged with stop 35 due to gravity.

Referring back to FIG. 1, when a bleeder valve of the gate valve type needs to be cleaned, an adapter 26 is screwed into the end of the bleeder valve to be cleaned if such adapter is necessary. With flexible casing 22 being flexible, adapter 26 can be connected to a bleeder valve where a small clearance is available, and handle 11 may be operated without requiring an operating personnel to maneuver into difficult positions. After adapter 26 has been screwed into the bleeder valve, a suitable union type fitting, such as flared joint 25, can be connected to adapter 26 to provide a fluid-tight joint with the bleeder valve. After a fluid-tight joint has been made, the bleeder valve may be opened and any fluid/solid flow through the bleeder valve will fill rigid casing 21 and will be prevented from escaping to the atmosphere by valve 30 (when closed) and by the action of packing 14. It is essential that rigid casing 21, valve 30, and packing 14 be selected to withstand the fluid/solid that they are subjected to during cleaning of the bleeder valve. When the gate valve is completely open, an open passageway is exposed into which drill 28 may be forced. Cleaning of the bleeder valve is effected by rotating handle 11 while it is advanced into packing gland 13. Such rotation, acting through flexible shaft 22 and coupling 27, causes drill bit 28 to rotate in the same direction and at the same rate as handle 11. As drill bit 28 advances into the bleeder valve to be cleaned, drill bit 28 dislodges solids and causes the passageways in the bleeder valve to become free of obstructions. If desired, valve 30 can be opened slightly at this point to carry dislodged material away from the bleeder valve through rigid casing 21 by causing a flow of fluid from the bleeder valve into rigid casing 21.

After the cleaning process has been completed, handle 11 is rotated while rigid shaft 12 is retracted from packing gland 13, and such rotation is continued until rigid shaft 12 has been fully withdrawn. After rigid shaft 12 has been completely withdrawn, drill bit 28 is completely clear of the bleeder valve after which the bleeder valve may be closed. Valve 30 can then be opened to relieve internal pressure within rigid casing 21 so that flared joint 25 may be broken to disassemble bleeder valve cleaner 10 from the bleeder valve.

When disassembled, bleeder valve cleaner 10 may be thoroughly cleaned by introducing a suitable cleaning fluid through valve 30 so that it washes through rigid casing 21 and discharges from the flared end around drill bit 28. Bleeder valve cleaner 10 may be further cleaned by inserting rigid shaft 12 into rigid casing 21 to its fullest extent thereby exposing the entire drill bit 28 and a substantial length of flexible shaft 22 that may be wiped by hand As an example, rigid casing 21 is a 9-inch long one-half inch seamless stainless steel tube having a wall thickness of 0.035 inches. Rigid shaft 12 is a stainless steel rod that is 13 inches long with a diameter of 5/16 inch. Packing gland 13 is made to receive ¼ by ¼ inch packing that may be made of Teflon® or TFE for temperatures up to 500° F. Flexible shaft 22 is a stainless steel cable with a diameter of ¼ inch. Valve 30 is a stainless steel ¼ inch ball valve.

As has been described, the present invention provides an improved apparatus for cleaning bleeder valves.

While the invention has been particularly shown and described with reference to a preferred embodiment, it will be understood by those skilled in the art that various changes in form and detail may be made therein without departing from the spirit and scope of the invention.

What is claimed is:

1. An apparatus for cleaning bleeder valves, said apparatus comprising:

a rigid casing;

a handle and a rigid shaft, wherein a portion of said rigid shaft is rotatably contained within said rigid casing;

a flexible casing rotatably connected to said rigid casing, wherein said flexible casing is adapted to provide fluid-tight coupling of said flexible casing to a bleeder valve to be cleaned, wherein said flexible casing, is made of materials that allow said flexible casing to be bent;

a flexible shaft connected to said rigid shaft, wherein a portion of said flexible shaft is rotatably contained within said flexible casing and extending from one end of said flexible casing to a position outwardly of an opposite end of said flexible casing;

a drill bit connected to said flexible shaft, wherein said drill bit includes first and second flutes extended longitudinally along a length of said drill bit, wherein said first flute includes a first cutting edge, and said second flute includes a second cutting edge; and a valve connected to said rigid casing and adapted for selective venting of an interior of said rigid casing.

2. The apparatus of claim 1, wherein said flexible casing is connected to said rigid casing via a connector, wherein said connector allows said valve to be rotated to an upright position irrespective of the position of said bleed valve cleaner.

3. The apparatus of claim 1, wherein said flexible casing is made of materials adapted to withstand temperature, pressure and chemical compositions of substances that enter said flexible casing during bleeder valve cleaning operations.

4. The apparatus of claim 1, wherein said valve is controlled by a safety handle having a safety latch capable of preventing said safety handle from rotation when said safety handle is placed at a relatively horizontal position.

5. The apparatus of claim 1, wherein said flexible shaft is a steel cable.

6. The apparatus of claim 1, wherein said rigid shaft is made of steel.

7. The apparatus of claim 1, wherein said safety latch is activated by gravity.

8. The apparatus of claim 1, wherein said rigid shaft is connected to said flexible shaft, wherein a portion of said rigid shaft is rotatably contained within said rigid casing, wherein said rigid shaft includes a set of scales positioned to indicate a distance at which said drill bit is located with respect to a bleeder valve to be cleaned.

9. The apparatus of claim 1, wherein said rigid shaft includes a first indicia and a second indicia located on two different positions of said rigid shaft.

10. The apparatus of claim 9, wherein said first indicia is for indicating that said drill is fully retracted from a bleeder valve, and said second indicia is for indicating that said drill is fully extended within a bleeder valve.

* * * * *